208-412 SR
C6306 OR 4,545,890

United States Patent [19]

Schindler et al.

[11] Patent Number: 4,545,890

[45] Date of Patent: Oct. 8, 1985

[54] COAL LIQUEFACTION AND HYDROGENATION

[75] Inventors: Harvey D. Schindler, Fair Lawn; James M. Chen, Edison, both of N.J.

[73] Assignee: Lummus Crest, Inc., Bloomfield, N.J.

[21] Appl. No.: 605,764

[22] Filed: Apr. 30, 1984

[51] Int. Cl.[4] ..... C10G 1/06

[52] U.S. Cl. ..... 208/8 LE; 208/10

[58] Field of Search ..... 208/8 LE, 10

[56] References Cited

U.S. PATENT DOCUMENTS

| | | | |
|---|---|---|---|
| 3,503,864 | 3/1970 | Nelson | 208/10 |
| 4,028,221 | 6/1977 | Sze et al. | 208/10 |
| 4,134,821 | 1/1979 | Gorin | 208/10 |
| 4,192,653 | 3/1980 | Gianetti et al. | 208/10 |
| 4,298,451 | 11/1981 | Neuworth | 208/10 |
| 4,300,996 | 11/1981 | Kuehler | 208/10 |
| 4,328,088 | 5/1982 | Anderson et al. | 208/10 |
| 4,347,117 | 8/1982 | Bauman et al. | 208/10 |
| 4,371,727 | 2/1983 | Gavin | 208/10 |
| 4,374,015 | 2/1983 | Brulé | 208/10 |
| 4,376,037 | 3/1983 | Dahlberg et al. | 208/10 |
| 4,379,744 | 4/1983 | Rosenthal et al. | 208/10 |
| 4,391,699 | 7/1983 | Rosenthal | 208/10 |
| 4,411,767 | 10/1983 | Garg | 208/10 |

*Primary Examiner*—D. E. Gantz
*Assistant Examiner*—Lance Johnson
*Attorney, Agent, or Firm*—Elliot M. Olstein

[57] ABSTRACT

Disclosed is a coal liquefaction process using two stages. The first stage liquefies the coal and maximizes the product while the second stage hydrocracks the remainder of the coal liquid to produce solvent.

18 Claims, 2 Drawing Figures

COAL LIQUEFACTION AND HYDROGENATION

Figure 1:
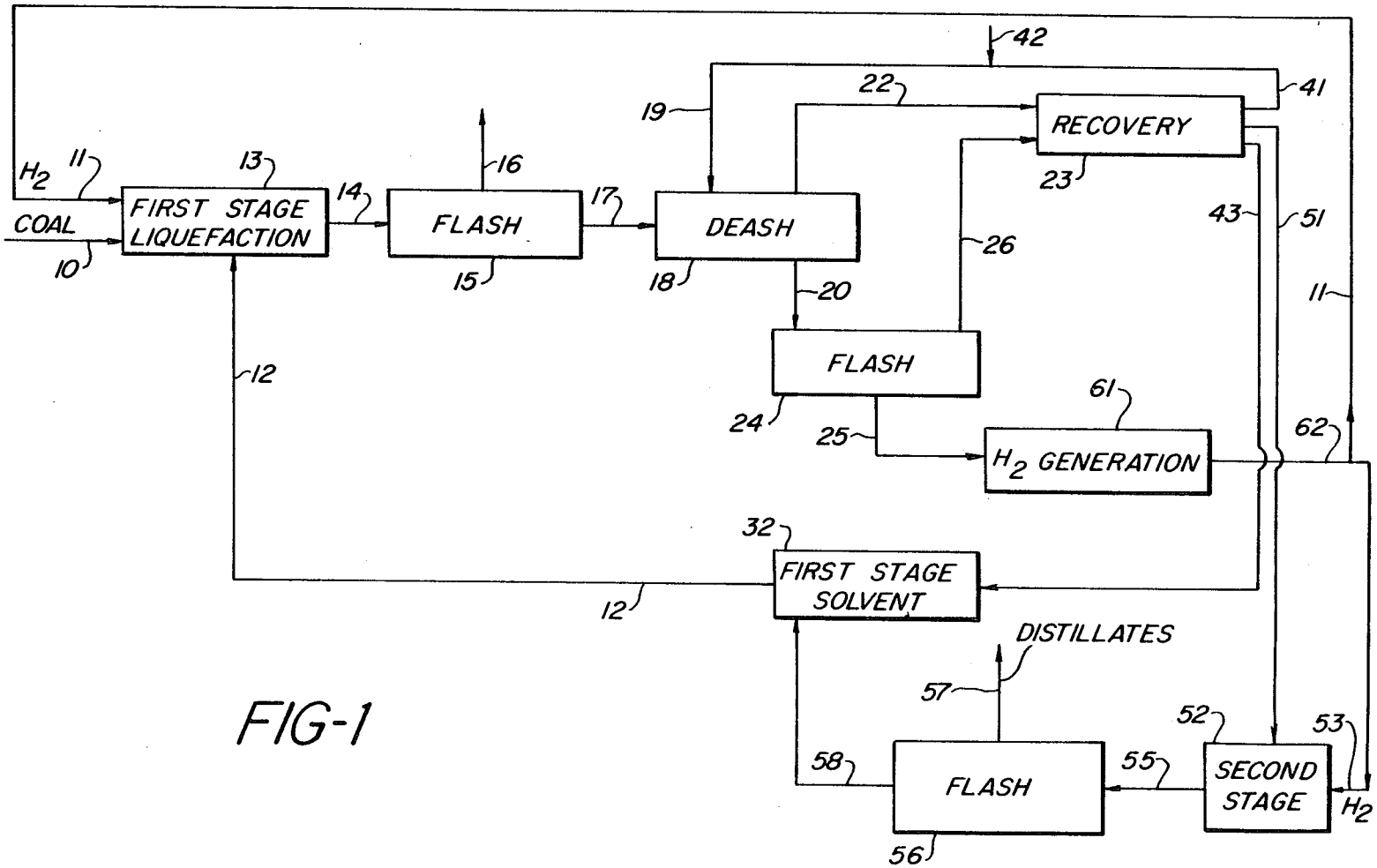

The Government has rights in this invention pursuant to Contract No. DE-AC22-79ETI 4804 awarded by the U.S. Department of Energy.

The present invention relates to liquefaction of coal, and more particularly to improvements in a two-stage process for coal liquefaction.

Coal has been liquefied in a single liquefaction stage comprised of a preheater coil where coal liquefaction is essentially completed, followed by a dissolver, where both liquefaction solvent and coal derived liquids are further hydrogenated.

Recently, there has been proposed a so-called two-stage liquefaction process wherein the first reaction stage is a short contact time thermal liquefaction, followed by recovery of essentially ash free liquid, which is upgraded by hydrogenation in a second liquefaction stage.

The present invention is directed to an improvement in such a two-stage liquefaction process.

In accordance with the present invention, there is provided an improvement in a two-stage liquefaction process wherein the liquefaction solvent to the first stage includes hydrogenated material recovered from the second stage liquefaction. The second stage conditions are controlled so as to produce materials which are suitable for use in formulating liquefaction solvent for the first stage.

More particularly, the second stage conditions are controlled in a manner such that the overall conversion of 850° F.+ material in the second stage is at least 30% and not greater than 60%, all by weight.

Applicant has found that by controlling the overall conversion, as hereinabove described, the second stage hydrogenation process produces material which boils within the range of 500° F. and 850° F. (850° F.− material) which is sufficient for use in formulating solvent for the first stage.

In addition to controlling conversion, the temperature of the second stage is controlled to provide a hydrogenation temperature of at least 650° F. and no greater than 795° F.

Applicant has found that by controlling both temperature and conversion, the material produced in the second stage contains both hydrogenated material which boils within the range from 500° F. to 850° F. (850° F.− material) and 850° F.+ material, and that such components have a hydrogen to carbon ratio which makes those materials particularly suitable for formulating a liquefaction solvent for the first stage.

The 850° F.+ material recovered from the second stage for use in formulating first stage solvent is the full range of material which boils above the nominal boiling temperature of 850° F. Such material is derived from the coal and contains hydrogenated components which improve the quality of the first stage liquefaction solvent.

Similarly, the material boiling from 500° F. to 850° F., recovered from the second stage, is derived from the coal, and contains hydrogenated components which improve the quality of the first stage liquefaction solvent.

Accordingly, the conditions in the second stage of a two-stage process for liquefying coal are controlled in a manner such that there can be recovered from the second stage sufficient material boiling within the range from 500° F. to 850° F., as well as 850° F.+ for use in formulating liquefaction solvent for the first stage.

As hereinabove indicated, the second stage is generally operated at an overall conversion of at least 30%, preferably at least 35%, and no greater than 60%, preferably no greater than 55%, based on 850° F.+ material present in the feed to the second stage.

By employing the hereinabove described conditions in the second stage, it is possible to provide a liquefaction solvent of improved quality in that a major portion thereof is formulated from hydrogenated materials recovered from the second stage; namely materials which boil above 500° F. (in some cases the materials recovered from the second stage and used in formulating the first stage solvent are the materials which boil above 650° F. in that depending on the pressure employed in the first stage liquefaction, it may be necessary to remove 500° to 650° F. components in that at low pressures the 500° to 650° F. components during the first stage).

In most cases, at least 60% and preferably at least 75% of the liquefaction solvent is formed from the materials recovered from the second stage which boil above 500° F., with the remainder of the liquefaction solvent, if any, being formed from materials recovered from the first stage liquefaction. The material derived from the first stage liquefaction which is used in formulating the first stage solvent is generally 850° F.− material which has an initial boiling point of at least 500° F. (in some cases the initial boiling point may be at least 650° F., as hereinabove noted). Thus, the first stage liquefaction solvent may be comprised of from 60% to 100% of material from the second stage and from 0% to 40% of 850° F.− material from the first stage. In most cases, the liquefaction solvent includes at least 5% (preferably at least 10%) and no greater than 25% of 850° F.− material from the first stage. In some cases, some 850° F.+ material derived from the first stage may be employed in formulating the first stage liquefaction solvent.

As hereinabove indicated, at least 60% and preferably at least 75%, all by weight, of the first stage liquefaction solvent is comprised of materials produced in the second stage under controlled conditions, and the materials derived from the second stage include both materials which boil of from 500° F. to 850° F. (850° F.− material) and materials which boil above 850° F. (850° F.+ material). The weight ratio of 850° F.− material to 850° F.+ material (both derived from a controlled operation of the second stage), in the liquefaction solvent, is generally at least 0.8:1, and preferably at least 1:1. In most cases, the weight ratio does not exceed 6:1. In general, the 850° F.− material has solvent qualities which are better than the 850° F.+ material so, in general, liquefaction solvent quality is improved by increasing the amount of 850° F.− material from the second stage. However, as a practical matter, overall economics dictate the maximum ratio of 850° F.− material to 850° F.+ material produced in the second stage for use in formulating first stage liquefaction solvent.

The liquefaction solvent produced in accordance with the present invention has improved solvent qualities. The first stage liquefaction solvent employed in accordance with the invention generally has a hydrogen to carbon ratio of at least 0.95:1, and preferably at least 1.0:1. In most cases, the hydrogen to carbon ratio does not exceed 1.25:1. As a result of such improved qualities, the hydrogen partial pressure in the first stage liquefaction may be reduced, without reducing the overall conversion in the first stage liquefaction.

In accordance with a preferred embodiment, the first stage liquefaction is a short contact thermal liquefaction which is operated at an outlet temperature in the order of from 800° to 875° F., and particularly 820° F. to 865° F.; at a pressure in the order of from 500 to 2700 psig and in cases where higher amounts of hydrogen are required, the pressure may be from 1800 to 2700 psig; and at reaction contact times (at temperatures above 600° F.) in the order of from 2 to 15 minutes. It may be possible in some cases to further reduce the residence time. The coal liquefaction solvent employed in the first stage is provided in an amount such that the ratio of solvent to coal is in the order of from 1.2:1 to 3:1, on a weight basis. It is to be understood that greater amounts could be employed but, in general, such greater amounts are not economically justified. In additional, hydrogen, when used, may be added to the first stage in an amount of from 2000 to 15,000 SCF per ton of coal; however, higher or lower amounts may be employed. In some cases, it may be possible to operate the first stage without the addition of gaseous hydrogen. Coal conversion in the first stage, based on moisture ash free coal is generally 90% or greater.

The above conditions are illustrative, and the scope of the invention is not to be limited thereby.

In the two stage process of the present invention, insoluble material derived from the coal may be removed either after the first stage or subsequent to the second stage, and such procedure is generally referred to as "deashing", even though materials in addition to ash are removed.

In accordance with a preferred embodiment, the deashing is accomplished by the use of a liquid promoter having a characterization factor of at least 9.75, a 5 volume percent distillation temperature of at least about 250° F., and a 95 volume percent distillation temperature of at least about 350° F. and no greater than about 750° F., as described in U.S. Pat. No. 3,856,675. As described in such patent, a preferred promoter liquid is a kerosene fraction having 5% and 95% volume distillation temperatures of 450° F. and 500° F., respectively. It is to be understood, however that other methods may be employed within the spirit and scope of the invention.

In the second stage, material recovered from the first stage, which may or may not include insoluble material derived form the coal, is hydrogenated with gaseous hydrogen at controlled temperatures and overall conversions, as hereinabove described. In general, the second stage is operated at pressures in the order of from 2000 to 3000 psig, and at space velocities which in combination with the controlled temperatures result in conversions as hereinabove described. In the second stage, such hydrogenation is effected in the presence of a hydrogenation catalyst of a type known in the art. For example, an oxide or sulfide of a group IV and group VIII metal, such as a cobalt-molybdenum or nickel-molybdenum catalyst, supported on a suitable support, such as alumina or silica-alumina. Such hydrogenation converts a portion of the 850° F.+ material to hydrogenated distillates ($C_5$ to 850° F. material) and also produces hydrogen donors in the 850° F+ residuum, as hereinabove described.

In accordance with a preferred embodiment, such second-stage liquefaction is accomplished is an upflow expanded bed, with such expanded bed being known in the art.

If insoluble material is not removed prior to the second stage, second stage effluent is treated to remove insoluble material so as to enable recovery of a "clean" product.

Figure 2:
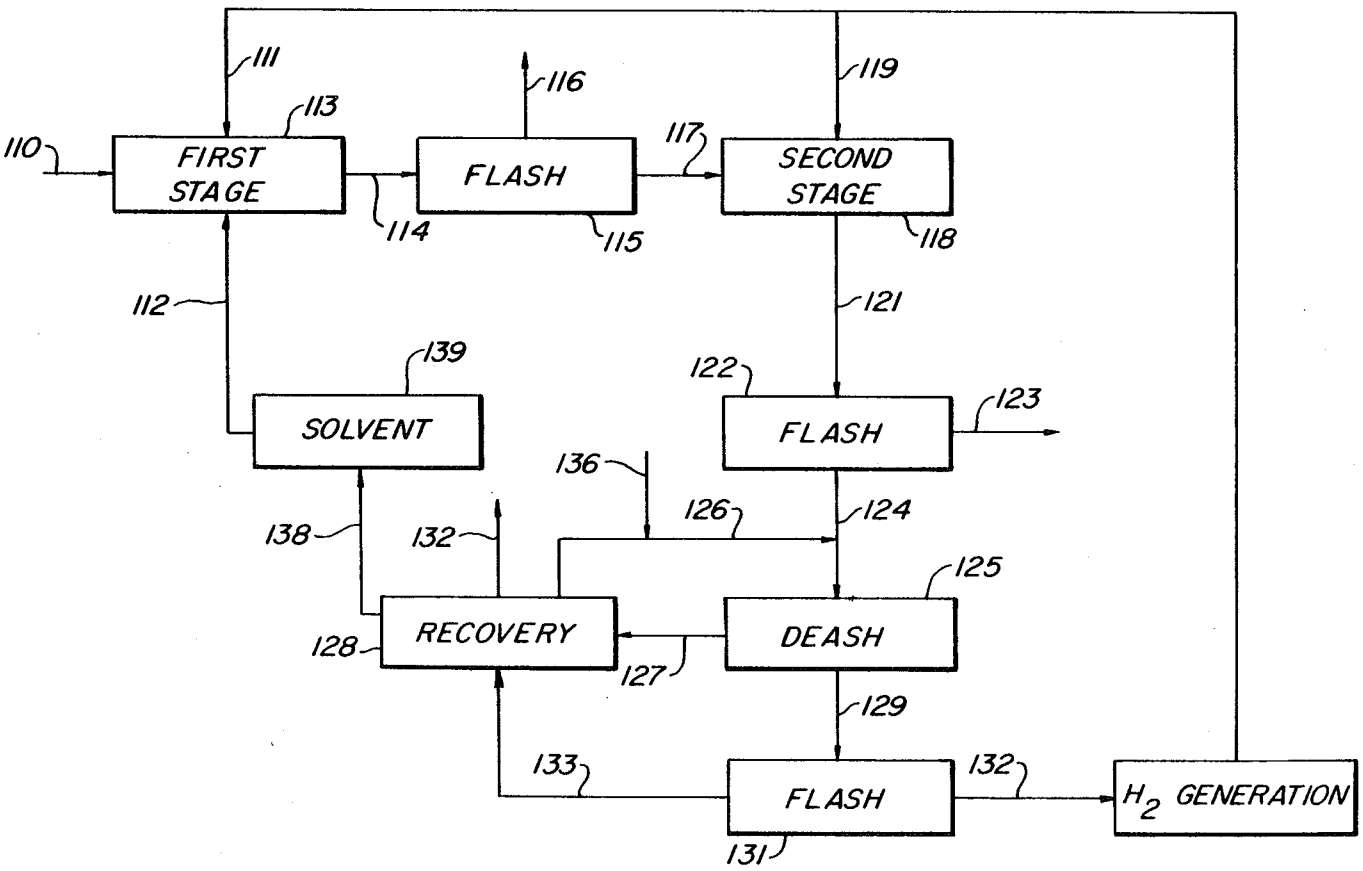

The invention will be further described with respect to embodiments thereof illustrated in the accompanying drawings, wherein:

FIG. 1 and FIG. 2 of the drawings are simplified schematic block flow diagrams of embodiments of the invention.

It is to be understood, however, that the scope of the invention is not to be limited to the particularly described embodiments.

Referring now to the drawing, ground pulverized coal, generally bituminous, sub-bituminous or lignite, preferably bituminous coal, in line 10, hydrogen, if used, in line 11, and a coal liquefaction solvent, in line 12, obtained as hereinafter described, are introduced into the first stage liquefaction zone, schematically generally indicated as 13 for effecting a short contact thermal liquefaction of the coal. The thermal liquefaction is effected in the absence of catalyst. The first stage liquefaction is operated at the conditions hereinabove described.

A first stage coal liquefaction product is withdrawn from zone 13 through line 14, and introduced into a flash zone, schematically generally indicated as 15 in order to flash therefrom materials boiling below 500° F., and in some cases materials boiling below 650° F. Such flashed materials are removed from flash zone 15 through line 16 as product.

The remainder of the coal liquefaction product, in line 17, is introduced into a deashing zone, schematically generally indicated as 18 for separating ash and other insoluble material from the first stage coal liquefaction product. As particularly described, the deashing in zone 18 is accomplished by use of a promoter liquid for promoting and enhancing the separation of the insoluble material, with such promoter liquid being provided through line 19. In particular, the separation in deashing zone 18 is accomplished in one or more gravity settlers, with the promoter liquid and general procedure for accomplishing such deashing being described, for example, in U.S. Pat. No. 3,856,675. As hereinabove indicated, such promoter liquid is preferably a kerosene fraction having 5% and 95% volume distillation temperatures of 425° F. and 500° F., respectively.

The essentially ash free overflow is withdrawn from deashing zone 18 through line 22 for introduction into a recovery zone, schematically generally indicated as 23.

An underflow containing insoluble material is withdrawn from deashing zone 18 through line 20, and introduced into a flash zone, schematically generally indicated as 24 to flash material boiling below 850° F. therefrom. The flashing in zone 24 is accomplished in a manner such that there is recovered from flash zone 24, through line 25, a flowable stream containing insoluble material and 850° F.+ material. The flashed components are withdrawn from flash zone 24 through line 26 for introduction into recovery zone 23.

The 850° F.+ material in line 25 including insoluble components may be used as feedstock for generation of hydrogen, in zone 61; for example a partial oxidation process. Hydrogen is recovered from zone 61 and a portion thereof, as required, is employed in line 11.

The recovery zone 23 is operated so as to separate and recover promoter liquid for use in line 41; any 850° F.− material to be used in formulating liquefaction solvent, in line 43, and 850° F.+ material, as well as any 850° F.− material not used in producing liquefaction solvent, in line 51. Recovery zone 23 may include an atmospheric flash as well as a distillation column, with the atmospheric flash being operated to flash 850° F.− material free of 850° F.+ material from the deashed liquid, with the unflashed material being distilled to recover promoter liquid through line 41 (for example 425° F. to 500° F. material) with the remainder (500° F. or 650° F. to 850° F.) being recovered through line 43 for use in formulating the first stage liquefaction solvent in first stage liquefaction solvent zone 32. Make-up promoter liquid may be added through line 42.

The material recovered from the atmospheric flash in recovery zone 23 through line 51 includes the 850° F.+ material present in the ash free overflow recovered from deashing zone 18, as well as that portion of 850° F.− material not used in formulating liquefaction solvent (generally 500° F. or 650° F. to 850° F. material) so as to provide a pumpable feed for introduction into a second stage, schematically generally indicated as 52 for hydrogenation with hydrogen in line 53, which is derived from the hydrogen generation zone 61. The second stage 52 is operated at temperatures, and pressures, as hereinabove described, preferably with the use of a hydrogenation catalyst of the type hereinabove described, to upgrade a portion of the 850° F.+ material to lower boiling components. In addition, hydrogen is added to both 850° F.+ and 850° F.− components.

In accordance with a preferred embodiment, the second liquefaction stage is in the form of an upflow expanded bed.

The effluent from the second stage liquefaction, in line 55 is introduced into a flash zone, schematically generally indicated as 56 to recover as product through line 57 gas, and $C_5$ to 850° F. components.

The unflashed portion of the effluent, recovered through line 58 for introduction into the first stage solvent formulation zone 32, includes all of the 850° F.+ material present in the second stage effluent, as well as unflashed 850° F.− material (generally 500° F. or 650° F. to 850° F. material), which is to be used in formulating first stage solvent. As a result of controlling the conditions in the second stage, as hereinabove described, the material in line 58 includes hydrogenated components boiling within the range of 500° F. to 850° F., and hydrogenated 850° F.+ components. The various components are employed in amounts as hereinabove described so as to provide liquefaction solvent for first stage 13.

A further embodiment of the invention is shown in FIG. 2, and in this embodiment deashing is accomplished subsequent to the second stage.

Referring now to FIG. 2 of the drawings, ground pulverized coal, generally bituminous, sub-bituminous of lignite, preferably bituminous coal, in line 110, hydrogen, if used, in line 111, and a coal liquefaction solvent, in line 112, obtained as hereinafter described, are introduced into the first stage liquefaction zone, schematically generally indicated as 113 for effecting a short contact thermal liquefaction of the coal. The thermal liquefaction is effected in the absence of catalyst. The first stage liquefaction is operated at the conditions hereinabove described.

A first stage coal liquefaction product is withdrawn from zone 113 through line 114, and introduced into a flash zone, schematically generally indicated as 115 in order to flash therefrom materials boiling below 500° F., and in some cases boiling below 650° F. Such flashed materials are removed from flash zone 115 through line 116, as product.

Unflashed material in line 117 is introduced into a second stage, schematically indicated as 118, for hydrogenation with hydrogen introduced through line 119, obtained as hereinafter described. The second stage 118 is operated under controlled conditions, as hereinabove described.

Second stage effluent is withdrawn from zone 118 through line 121 and introduced into a flash zone 122 in order to flash therefrom materials boiling below 500° F., and in some cases below 650° F. Such flashed materials are recovered as product through line 123.

The remainder of the product, in line 124, is introduced into a deashing zone, schematically generally indicated as 125, for separating ash and other insoluble material from the product. As particularly described, the deashing in zone 125 is accomplished by use of a promoter liqued for promoting and enhancing the separation of the insoluble material, with such promoter liquid being provided through line 126. In particular, the deashing in deashing zone 125 is accomplished as hereinabove described.

An essentially ash free overflow is withdrawn from deashing zone 125 through line 127 for introduction into a recovery zone, schematically generally indicated as 128.

Recovery zone 128 is operated to recover promoter liquid in line 126 (make-up promoter liquid is added through line 136); net product, comprised of gas and $C_5$ to 850° F. material in line 137; and, in line 138 all of the 850° F.+ material present in the second stage effluent, as well as that portion of the 850° F.− material present in the second stage effluent which is to be used in the first stage solvent storage zone 139 for formulating solvent for the first stage.

Underflow, containing insoluble material, is withdrawn from deashing zone 125 through line 129, and introduced into a flash zone, schematically generally indicated as 131, to flash materials boiling below 850° F. therefrom. The flashing in zone 131 is accomplished in a manner such that there is recovered from flash zone 131, through line 132, a flowable stream containing insoluble material and 850° F.+ material. The flashed components are withdrawn from flash zone 131 through line 133 for introduction into recovery zone 128.

The 850° F.+ material in line 132 including insoluble components may be used as feedstock for generating hydrogen; for example a partial oxidation process, for use, as required in lines 111 and 119.

Although the invention has been described with respect to preferred embodiments, such embodiments may be modified within the spirit and scope of the invention.

For example, deashing may be accomplished other than as described. Similarly, the second stage hydrogenation may be accomplished other than in an expanded bed.

Although it is preferred to employ some 850° F.− material from the first stage in formulating the liquefaction solvent in accordance with the embodiment in of FIG. 1 in that such use reduces the amount of material which is processed in the second stage, it is to be understood that all of the 850° F.− material from the first stage may be introduced into the second stage.

The above modifications and others should be apparent to those skilled in the art from the teachings herein.

The invention will be further described with respect to the following example, however, the scope of the invention is not to be limited thereby:

EXAMPLE

Bituminous coal is liquefied in two stages in accordance with the embodiment of FIG. 1.

The conditions in the first stage are presented in Table 1. The first stage solvent properties are presented in Table 2. First stage overall yields are presented in Table 3. Second Stage conditions and yields are in Table 4.

TABLE 1

| Reaction Conditions - First Stage | |
|---|---|
| Coal Feed Rate, lbs/hr - cu. ft. above 600° F. | 182 |
| Coal Concentration, wt. % | 36 |
| H2 Feed Rate, SCF/ton coal | 14,667 |
| Temperature, °F. | |
| inlet | 600 |
| outlet | 840 |
| Pressure, psig | 2,000 |
| Liquid residence time, minutes | 2.0 |
| Coal identification | Illinois No. 6 Burning Star Mine |
| Coal Conversion, % moisture, ash-free coal | 91.9 |
| Hydrogen Consumption, wt. % of coal | |
| molecular hydrogen | 0.43 |
| solvent hydrogen | 1.20 |

TABLE 2

| Liquefaction Solvent | Wt. % |
|---|---|
| 500° F.-850° F. (from first stage) | 20.0 |
| 500° F.-850° F. (from second stage) | 42.4 |
| 850° F.+ (from the second stage) | 37.6 |
| Heptane Insolubles | 20.84 |
| Toluene Insolubles | 8.75 |
| Quinoline Insolubles | 0.48 |
| Hydrogen to Carbon Ratio | 1.0 |

TABLE 3

| Yields | Wt. % |
|---|---|
| $H_2S$, $NH_3$, $H_2O$, CO, $CO_2$ | 5.97 |
| $C_1$-$C_4$ | 0.81 |
| $C_5$-390° F. | 0.04 |
| 390-500° F. | 1.85 |
| 500-650° F. | 3.80 |
| 650-850° F. | 10.10 |
| 850° F.+ (inc. ash and unconverted coal) | 77.83 |
| | 100.43 |

TABLE 4

| Second Stage Conditions | |
|---|---|
| Reactor Temperature, °F. | 735 |
| Reactor Pressure, psig | 2700 |
| Liquid Hourly Space Velocity volume 850° F.+ feed/hr-volume catalyst | 0.41 |
| Hydrogen Feed Rate, SCF/bbl | 6000 |
| Conversion of 850° F.+, wt. percent | 45.0 |
| Feed Composition, wt. % | |
| 500-650° F. | 3.77 |
| 650-850° F. | 45.56 |
| 850° F.+ | 50.67 |
| Yields, Wt. Percent of Feed | |
| $H_2$, $CO_x$, $NH_3$, $H_2S$ | 3.37 |

TABLE 4-continued

| | |
|---|---|
| $C_1$-$C_4$ | 0.72 |
| $C_5$-350° F. | 1.70 |
| 390-500° F. | 2.93 |
| 500-650° F. | 17.07 |
| 650-850° F. | 49.13 |
| 850° F. | 27.77 |
| | 102.69 |

The present invention is particularly advantageous in that by controlling second stage conditions and formulating the first stage solvent, as described, it is possible to operate the first stage at low consumption of gaseous hydrogen; i.e., no greater than 1.0 weight percent. Thus, if desired, the first stage can be operated at lower pressures. Moreover, it is possible to achieve such a result without a separate step for hydrogenating recycle components to be used in the first stage solvent.

In addition, it is possible to operate the first stage at short residence times; for example, two minutes or less (at temperatures above 600° F.) while maintaining high conversion; i.e., at least 90% in that hydrogen values are rapidly transferred from the solvent.

Furthermore, as a result of the presence of 850° F.+ material in the liquefaction solvent, coking is reduced in the first stage reactor.

In addition, the process is maintained in hydrogen balance by generating hydrogen from a mixture of insoluble material and 850° F.+ material derived from the coal feed.

These and other advantages should be apparent to those skilled in the art from the teachings herein.

Numerous modifications and variations of the present invention are possible in light of the above teachings and, therefore, within the scope of the appended claims the invention may be practiced otherwise than as particularly described.

What is claimed is:

1. A two-stage process for the liquefaction of coal, comprising:

contacting coal with liquefaction solvent in a first stage to produce a first effluent containing 850° F.− material and 850° F.+ material; recovering from the first effluent a feed (mixture) material comprising at least a portion of the 850° F.− material and 850° F.+ material; hydrogenating said feed (mixture) material in a second stage at a temperature of from 650° F. to 795° F. and at an overall conversion, based on 850° F.+ material, of at least 30% and no greater than 60% to produce a second effluent comprising 850° F.− material and 850° F.+ material; recovering from the second effluent a portion of the 850° F.− material as product, and a mixture of 850° F.− material and 850° F.+ material, said mixture having a ratio of 850° F.− material to 850° F.+ material of from 0.8:1 to 6:1; and directly employing said mixture, without additional hydrogenation, as at least a portion of the liquefaction solvent used in the first stage, said liquefaction solvent being comprised of from 0% to 40% of 850° F.− material having an initial boiling point of at least 500° F. recovered from the first stage effluent, and said mixture in an amount from 60% to 100% (of said mixture), all by weight.

2. The process of claim 1 wherein the 850° F.− material from the first stage is present in the liquefaction solvent in an amount from 5% to 25%.

3. The process of claim 1 wherein the first stage is a short contact time thermal liquefaction.

4. The process of claim 1 wherein said ratio of 850° F.− material to 850° F.+ material recovered from the second stage is at least 1:1.

5. The process of claim 1 wherein the liquefaction solvent has a hydrogen to carbon ratio of at least 0.95:1.

6. The process of claim 1 wherein the first stage is a short contact thermal liquefaction operated at an outlet temperature of from 800° F. to 875° F.

7. The process of claim 6 wherein gaseous hydrogen is employed in the first stage and gaseous hydrogen consumption in the first stage is less than 1%.

8. The process of claim 7 wherein residence time for the first stage at temperatures above 600° F. is 2 to 15 minutes.

9. The process of claim 8 wherein conversion of moisture ash free coal in the first stage is at least 90%.

10. The process of claim 9 wherein a mixture of insoluble material and 850° F.+ material derived from the coal is recovered from one of the two stages and further comprising producing hydrogen from the mixture for use in the liquefaction process.

11. The process of claim 1 wherein the coal is bituminous coal.

12. A two-stage process for liquefying bituminous coal, comprising:

contacting bituminous coal with a liquefaction solvent in a first stage to produce a first effluent containing 850° F.− and 850° F.+ material; recovering from the first effluent an essentially ash-free feed material comprising at least a portion of the 850° F.− material and 850° F.+ material; hydrogenating said feed material in a second stage at a temperature of from 650° F. to 795° F. and at an overall conversion, based on 850° F.+ material, of at least 30% and no greater than 60% to produce a second effluent; recovering from the second effluent a portion of the 850° F.− material, as product, and a remaining mixture of 850° F.+ material and 850° F.− material, said remaining mixture having a ratio of 850° F.− material to 850° F.+ material of from 0.8:1 to 6:1; and directly employing said remaining mixture, without additional hydrogenation, as at least a portion of the liquefaction solvent in the first stage, said liquefaction solvent being comprised of said remaining mixture in an amount of from 60% to 100% (of said remaining mixture,) and from 0% to 40% of 850° F.− material recovered from the first effluent, all by weight.

13. The process of claim 12 wherein the 850° F.− material from the first stage is present in the liquefaction solvent in an amount of from 5% to 25%.

14. The process of claim 13 wherein the first stage is a short contact thermal liquefaction operated at an outlet temperature of from 800° F. to 875° F.

15. The process of claim 14 wherein residence time for the first stage at temperatures above 600° F. is 2 to 15 minutes.

16. The process of claim 15 wherein 850° F.− material from the first stage is present in the liquefaction solvent in an amount of from 10% to 25%.

17. The process of claim 16 wherein conversion of moisture ash free coal in the first stage is at least 90%.

18. The process of claim 17 wherein gaseous hydrogen is employed in the first stage and gaseous hydrogen consumption in the first stage is less than 1%.

* * * * *